US005266758A

United States Patent [19]

Pham et al.

[11] Patent Number: 5,266,758

[45] Date of Patent: Nov. 30, 1993

[54] $SF_6$ CIRCUIT BREAKER HAVING AN INCORPORATED CAPACITOR

[75] Inventors: Van Doan Pham; Edmond Thuries; Joseph Martin, all of Meyzieu, France

[73] Assignee: GEC Alsthom SA, Paris, France

[21] Appl. No.: 781,871

[22] Filed: Oct. 24, 1991

[30] Foreign Application Priority Data

Oct. 24, 1990 [FR] France ..... 90 13176

[51] Int. Cl.[5] ..... H01H 33/16; H01H 33/88

[52] U.S. Cl. ..... 200/144 AP; 200/148 R; 200/148 A

[58] Field of Search ..... 200/144 AP, 148 R, 148 A, 200/150 G

[56] References Cited

U.S. PATENT DOCUMENTS

| | | | |
|---|---|---|---|
| 4,204,101 | 5/1980 | Dethlefsen | 200/148 R X |
| 4,383,150 | 5/1983 | Cromer et al. | 200/144 AP |
| 4,421,962 | 12/1983 | Thuries et al. | 200/144 AP |
| 4,880,946 | 11/1989 | Thuries et al. | 200/148 R X |
| 4,983,791 | 1/1991 | Thuries et al. | 200/148 A |
| 5,124,872 | 6/1992 | Pham et al. | 361/11 |

FOREIGN PATENT DOCUMENTS

| | | |
|---|---|---|
| 1322238 | 12/1963 | France . |
| 2503448 | 8/1982 | France . |
| 2506067 | 11/1982 | France . |
| 1-313823 | 12/1989 | Japan . |
| 1112745 | 5/1968 | United Kingdom . |

OTHER PUBLICATIONS

French Search Report, 11 Jun. 1991.

*Primary Examiner*—J. R. Scott

*Attorney, Agent, or Firm*—Sughrue, Mion, Zinn, Macpeak & Seas

[57] ABSTRACT

A high tension circuit breaker includes a gastight cylindrical insulating case filled with $SF_6$ gas or the like and defining for each phase at least one current interrupting chamber. A fixed main contact and a fixed arcing contact are fixedly mounted within the chamber. Moving equipment of the circuit breaker includes moving main and arcing contacts and a member for moving the moving main and arcing contacts towards and away from the fixed main contact and the fixed arcing contact. A cylinder is fixedly mounted in said chamber and supports internally a movable blast piston and terminates in a blast nozzle facing the fixed contacts. A capacitor is disposed inside the circuit interrupting chamber optionally with a parallel connected varistor. A mechanism in the form of a switch including a fixed and a movable contact operates to insert the capacitor and the parallel connected varistor temporarily during both closing and opening of the circuit breaker contacts. The capacitor is constituted by a stack of capacitor components disposed in a fixed insulating tube mounted within the chamber. A first end of the stack is electrically connected to a first current terminal of the circuit breaker, and a second end of the stack is electrically connected to an electrode fixed to a piece of the moving equipment and electrically connected to a second current terminal of the circuit breaker. The electrode may be a tube coaxial with the case and internally of the case.

7 Claims, 5 Drawing Sheets

$SF_6$ CIRCUIT BREAKER HAVING AN INCORPORATED CAPACITOR

The present invention relates to a dielectric gas circuit breaker with an incorporated capacitor.

BACKGROUND OF THE INVENTION

Sulfur hexafluoride ($SF_6$) circuit breakers for interrupting high line fault currents often require a high value capacitance to be present at their terminals, e.g. a capacitance of several thousand picofarads. In conventional (i.e. non-metal clad) circuit breaker technology, this capacitance is housed in porcelain which, for installation purposes, is necessarily large in size.

An object of the invention is to provide a circuit breaker having a capacitor of greatly reduced total volume.

Another object of the invention is to provide a circuit breaker in which the capacitor is no longer connected to the terminals of the circuit breaker when the circuit breaker is in the disengaged position.

SUMMARY OF THE INVENTION

According to the invention, this object is achieved by placing the capacitor in series with a switch inside the porcelain containing the circuit interrupting chamber.

The Applicant has observed that in most cases, the switch associated with a 5000 pF capacitor needs to be able to interrupt a capacitive current that does not exceed 1 amp. This is relatively easy in $SF_6$ at a pressure of several bars, particularly if the moving contact of the switch is fixed to the moving contact of the main chamber, thus ensuring high disengagement speed.

The capacitor may be constituted by metal sheets separated by a very thin insulating sheet impregnated with oil or in an $SF_6$ environment.

In various embodiments, the capacitor may be placed inside the chamber, even if the chamber already contains a varistor for providing surge protection.

BRIEF DESCRIPTION OF THE DRAWINGS

Embodiments of the invention are described by way of example with reference to the accompanying drawings, in which.

DETAILED DESCRIPTION

Figure 1:
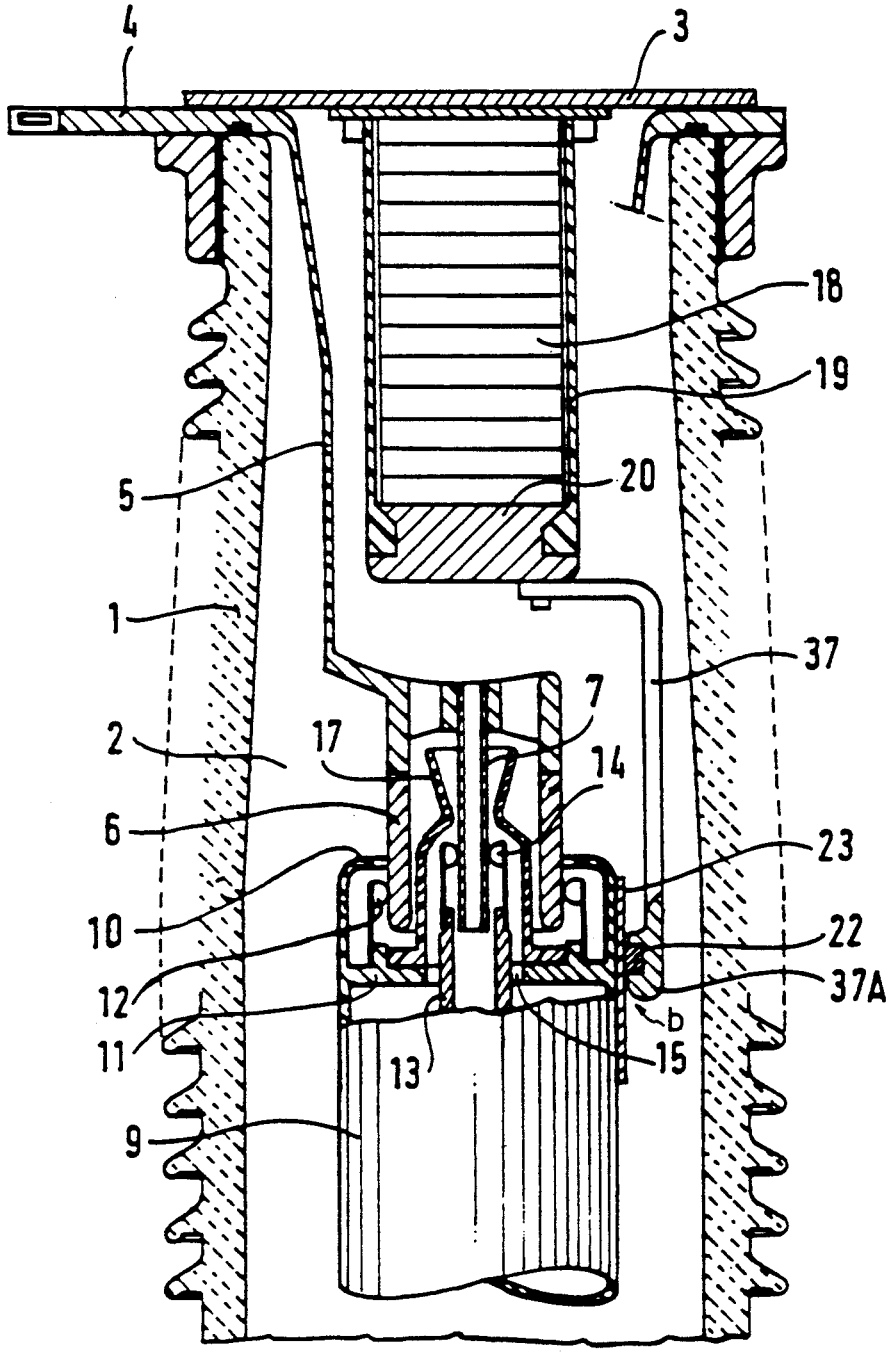
FIG. 1 is a fragmentary axial section view through a first embodiment of an interrupting chamber having a capacitor placed inside the chamber.

In FIG. 1, reference 1 designates an insulating case, preferably made of porcelain, delimiting a chamber or volume 2 containing the circuit interrupting components of the circuit breaker. The insulating case is closed at one end by a metal plate 3 which is fixed to a metal ring 4 constituting a first current terminal, and which is extended inside the case by arms 5 to which the following are fixed: a first metal tube 6 constituting the main fixed contact, and a second tube 7 coaxial with the first and constituting the fixed arcing contact.

The volume 2 is filled with a gas having good dielectric properties, such as sulfur hexafluoride, and at a pressure of a few bars.

The moving equipment of the circuit breaker indicated generally at a comprises a metal tube 9 extended by an anti-corona cap 10, and provided with a transverse metal partition 11 carrying contact fingers 12 that constitute the main moving contact, and a blast tube 13 extended by contact fingers 14 constituting the moving arcing contact. The partition is pierced by holes 15 to allow the blast gas to pass therethrough and it carries a blast nozzle 17 made of insulating material. Blast is provided by a fixed piston 25 disposed inside the tube 9 and not shown in FIG. 1. The tube 9 is connected via sliding contacts (not shown) to a second current terminal of the circuit breaker.

According to the invention, the capacitor associated with the current interrupting chamber is housed inside said chamber. It is constituted by a stack of a certain number of capacitor components 18 disposed in an insulating cylindrical case 19 fixed at one end to the plate 3 and closed at its other end by a metal block 20.

The capacitor is inserted in parallel with the contacts of the circuit breaker by metal arms 37 fixed to the blocks 20 and provided at their ends with a contact ring 22, e.g. made of copper. This ring is in contact with a tubular metal electrode 23 fixed on the tube 9.

When the circuit breaker is in the engaged position (position shown in FIG. 1), the ring 22 is in contact with the electrode 23 such that the capacitor formed by the components 18 is connected in parallel across the terminals of the circuit breaker.

During disengagement, the ring 22 loses contact with the electrode 23 which moves together with the moving equipment downwards in the figure so that the capacitor is disconnected when the circuit breaker is in its disengaged position.

Figure 2:
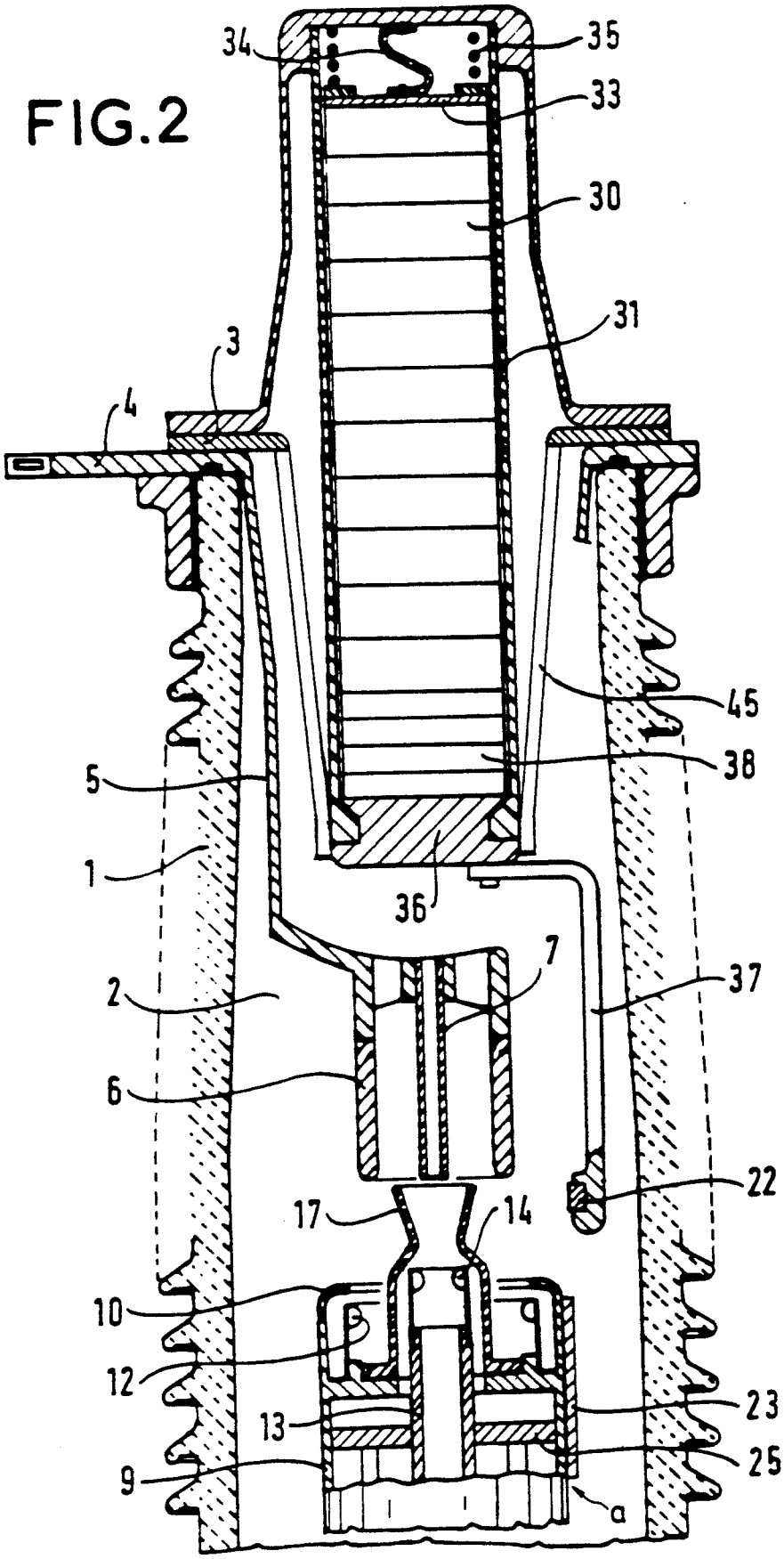
FIG. 2 is a fragmentary axial section view of a variant of the first embodiment of an interrupting chamber with a varistor and a capacitor placed inside the chamber.

FIG. 2 shows a variant of the first embodiment in which the capacitor is disposed inside the current interrupting chamber in parallel with a varistor. Components that are common to FIGS. 1 and 2 are given the same reference numerals.

The circuit breaker is shown in disengaged position, and the blast piston 25 can be seen.

The plate 3 is pierced by a central hole to make it possible to house a varistor constituted by components 30 and a resistor in series therewith and constituted by components 38, the components 30 and 38 being stacked in an insulating tube 31.

The varistor components may be based on zinc oxides (ZnO) or on silicon carbide (SiC). The resistor components are based on carbon.

The tube 31 is fixed to the top portion of a metal cap 32 closing the top end of the current interrupting chamber and in electrical contact with the metal plate 3. The stack of components is surmounted by a metal plate 33 connected by a braid 34 to the cap 32 and is compressed by a spring 35 bearing against the top of the cap.

The bottom portion of the tube 31 is closed by a metal block 36 carrying arms 37 whose ends are fixed to a metal ring 22, e.g. made of copper, which co-operates with the electrode 23 for inserting the varistor defining therebetween a switch indicated generally at b, FIG. 1.

The capacitor 45 is implemented in frustoconical shape and is mechanically and electrically connected firstly to the plate 3 and secondly to the metal block 36. The capacitor 45 coaxial with the varistor and surrounding it in part is connected in parallel with the varistor, and the capacitor-varistor assembly is in parallel with the contacts of the circuit breaker.

The function of the varistor is to limit surges, the function of the high value capacitor is to lengthen the delay time (td in the CEI standards) of the transient restoration voltage and to reduce the oscillation frequency of the line voltage when interrupting a near fault (within about one kilometer).

Figure 3:
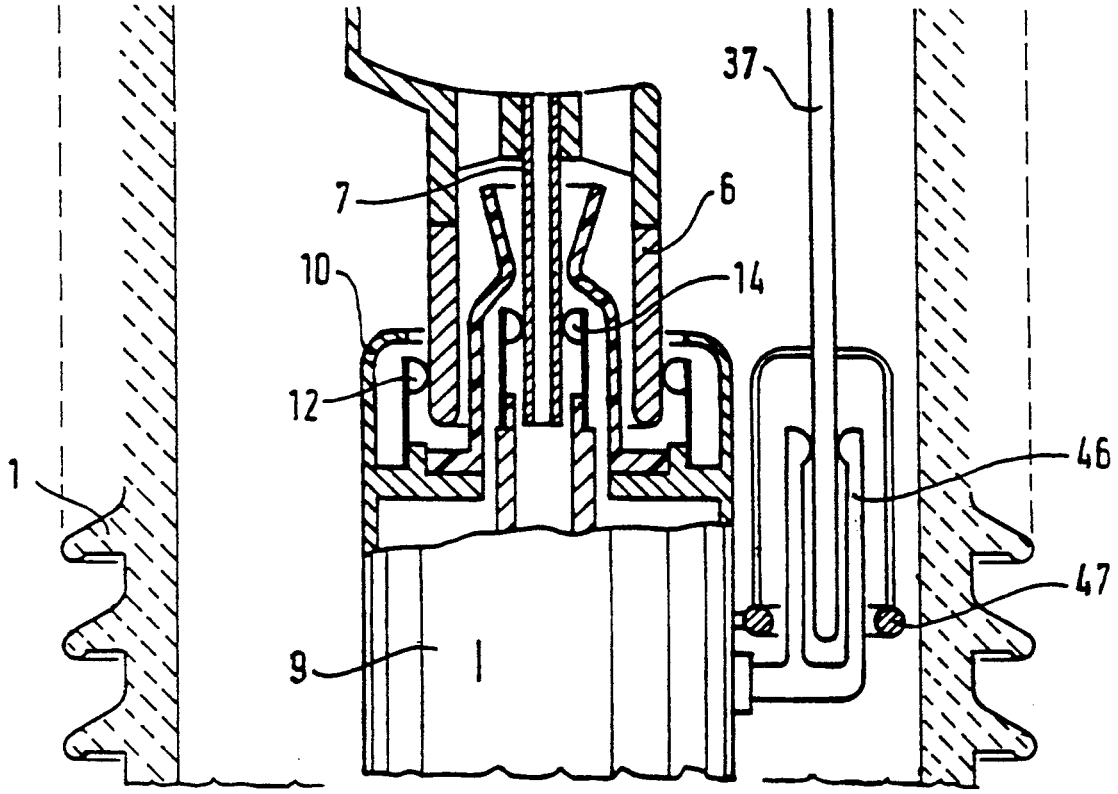
FIG. 3 shows one embodiment of a mechanism for inserting the varistor and the capacitors.

FIG. 3 shows a variant embodiment in which the rod 37 engages a tubular electrode 46 that is mechanically and electrically connected to the tube 9. An anti-corona ring 47 fixed to the rod 37 is placed level with the end of the electrode. For reasons of symmetry and mechanical balancing of the apparatus, the circuit breaker may include a second tubular electrode engagable with another arm 37 and disposed symmetrically about the axis of the tube 9.

Figure 5:
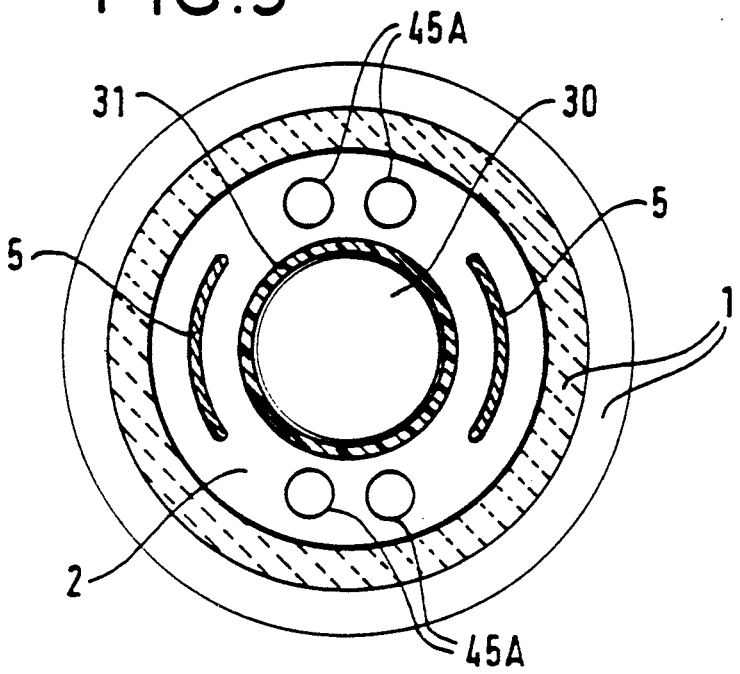
FIG. 5 is a section view on line V—V of FIG. 4.
Figure 4:
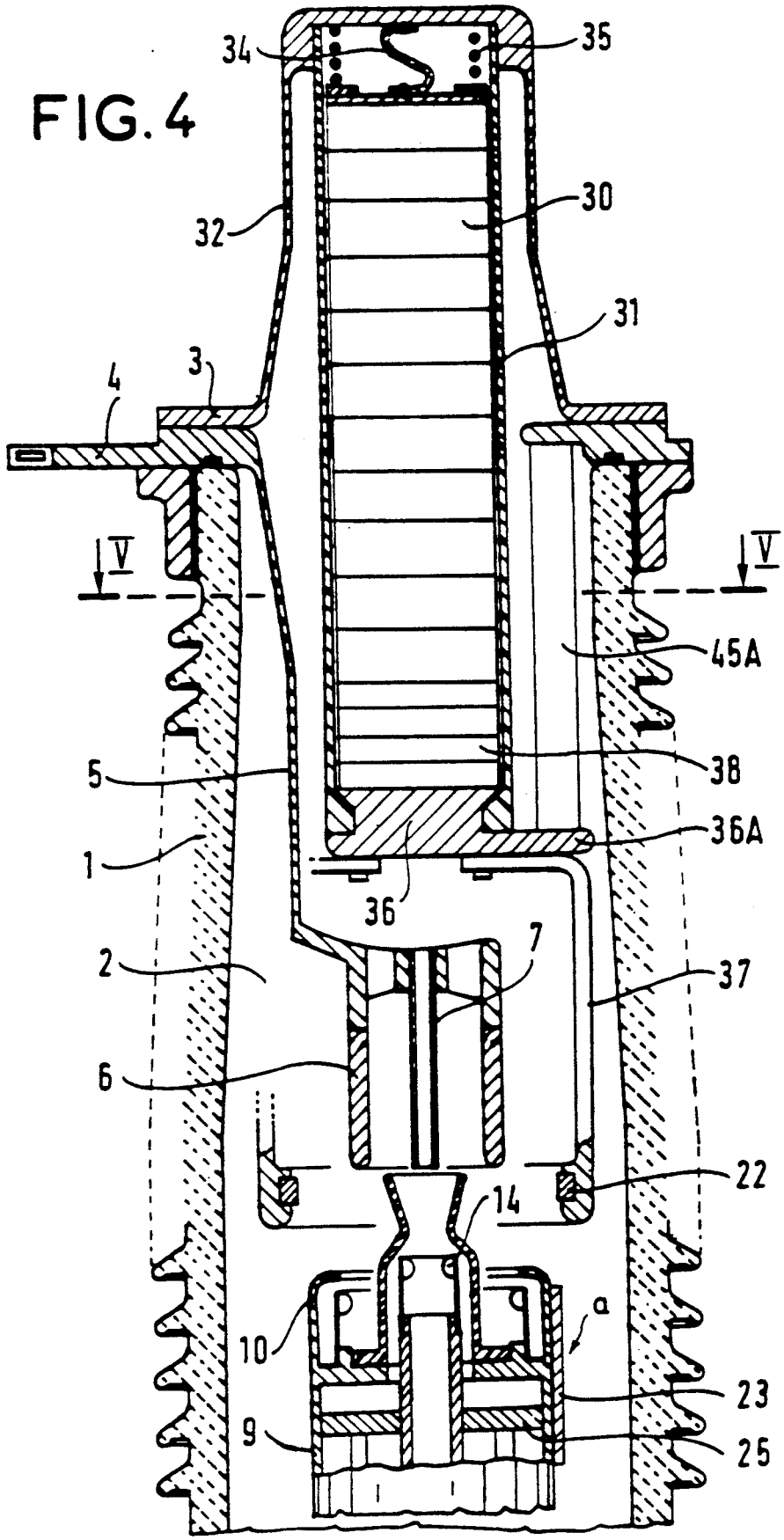
FIG. 4 is a fragmentary axial section view of a second embodiment of a circuit breaker including capacitors and a varistor.

FIGS. 4 and 5 show a second embodiment of the circuit breaker of the invention. Items that are common to FIGS. 4, 5, and 2 are given the same reference numerals.

The capacitor is made up of a plurality (preferably four) cylindrical capacitor components 45A connected in parallel. They are mechanically and electrically connected at one end firstly to the plate 3 (which may advantageously be integral with the plate 4), and at an opposite end secondly to the block 36 which has shoulders 36A.

Compared with the embodiment of FIG. 2, this embodiment has the advantage of enabling commercially-available cylindrical capacitors to be used.

The insertion mechanism of FIG. 3 is applicable to the embodiment of FIG. 4.

Figure 6:
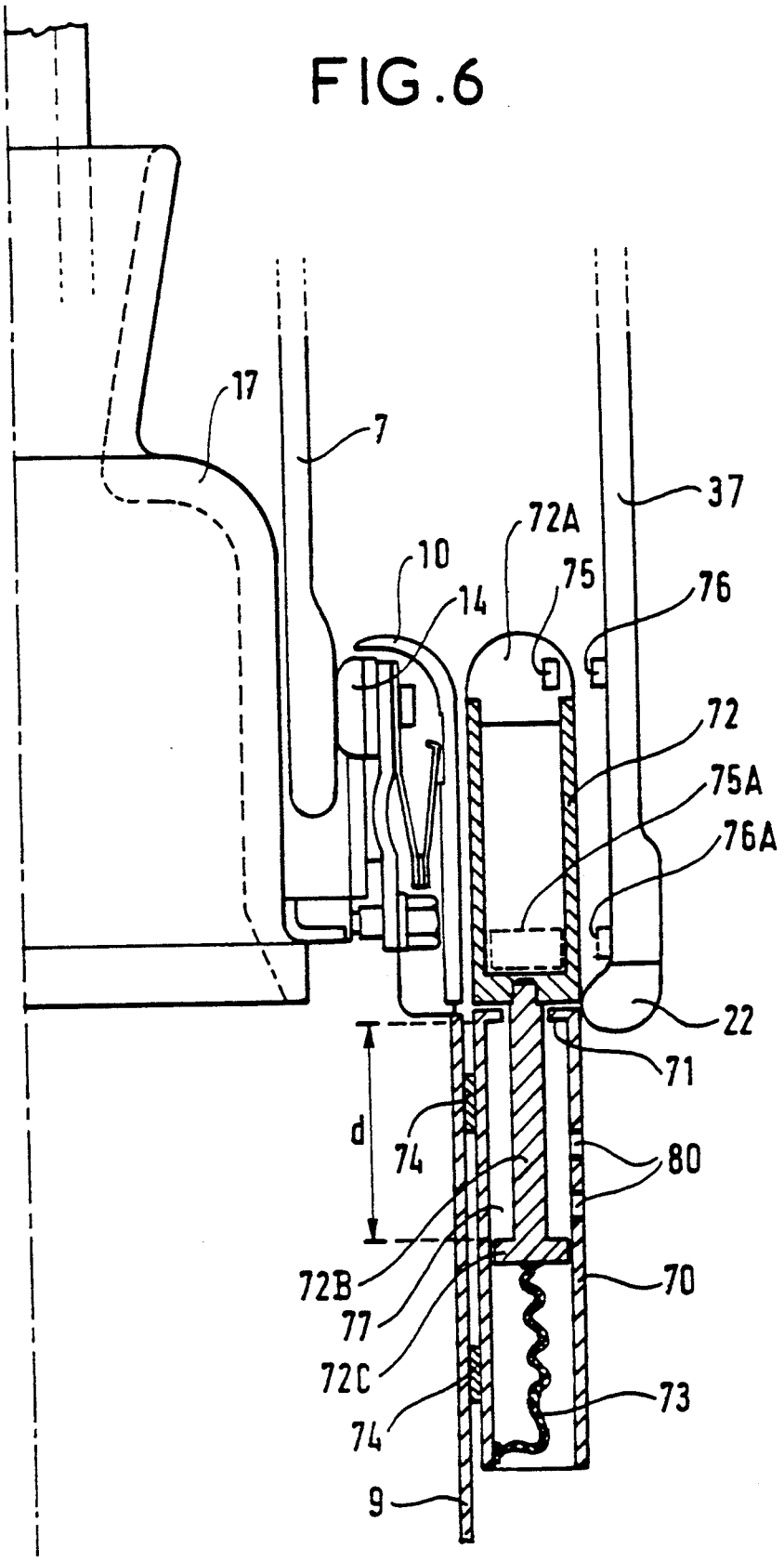
FIG. 6 is a view of another variant of a mechanism for inserting capacitors and the varistor.

FIG. 6 shows another embodiment of the insertion mechanism for the varistor and the capacitors.

The arm 37 carries an electrode 22 which engages with a metal tube 70 delimiting a volume 77 and which is provided with a top lid or cover 71 that is pierced by a hole. A metal piece 72 having a head 72A, a shank 72B, and an abutment 72C is capable of moving relative to the tube 70 over a distance d.

The height of the head 72A is selected to avoid it standing beyond the cap 10 when the circuit breaker is in the engaged position (FIG. 6). The width of the tube 72 is selected so that the electrode 22 comes into electrical contact with the tube and the head 72A during a circuit breaker opening operation. Holes 80 formed through the tube 70 prevent the gas inside the volume 77 compressing too quickly at the beginning of the stroke.

The piece 72 is electrically connected by a braid 73 to the tube 70. The tube 70 is mechanically fixed and electrically connected to the tube 9, e.g. by brazing 74.

The head 72A, FIG. 6, carries a magnet 75 which, when the circuit breaker is in the engaged position, is level with a magnet 76 carried by the arm 37. The head 72A may simply be made of mild steel. It is possible to replace the magnets 75 and 76 by magnets 75A and 76A, illustrated in dotted lines.

Operation is as follows:

In the engaged position, the varistor 30 and the capacitors 45*a* are short circuited by the contacts of the circuit breaker.

An disengagement, the moving equipment a is displaced downwards in FIG. 2.

Because of inertia and the attraction between the magnets, the piece 72 remains stationary such that contact between the electrode 22 and the tube 9 via the tube 70, the piece 72, and the braid 73 lasts for a period of time that is longer than that in the embodiment of FIG. 3, with the extra duration corresponding to the tube 9 travelling the distance d.

Between the instant when the arcing contacts 7 and 14 separate and the instant when the electrode 22 leaves the head 72A, the varistor and the capacitors are inserted in parallel with the circuit breaking arc. At the end of the disengagement operation, the head 72A drops by gravity back onto the cover 71. It is possible to install a low-stiffness spring between the cover 71 and the abutment 72C to facilitate returning the piece 72 on the cover 71 at the end of stroke.

While the circuit breaker is closing, the tube 70 drives the head 72A by contact between cover 71 and metal piece 72; which returns to the position shown in FIG. 6, and returns accurately because of the magnets, thereby inserting the varistor 30 before the arcing contacts 14 and 7 come into contact with each other.

To balance the device, it is advantageous to place a second insertion system that is identical to that described above and that is disposed symmetrically about the axis of the tube 9.

The circuit breaker for which several embodiments are described above constituted a fifth generation $SF_6$ circuit breaker, following the double pressure circuit breakers of the 1960s (first generation), puffer circuit breakers (second generation), circuit breakers having a thermal volume (third generation), and thermal expansion circuit breakers having assisted displacement moving equipment.

This fifth generation circuit breaker provides better current interruption and is automatically protected against surges. The dispositions of the present invention are also applicable to metal-clad circuit breakers (circuit breakers having metal cladding that is grounded).

We claim:

1. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arcing contact fixedly mounted within said at least one chamber, moving equipment comprising at least one moving main contact and at least one moving arcing contact mounted within said at least one chamber for movement towards and away from said fixed main contact and said fixed arcing contact respectively, means for moving said moving main and arcing contacts towards and away from said fixed main contact and said fixed arcing contact respectively, said chamber further comprising a cylinder, a blast piston within said cylinder, and a blast nozzle, the improvement comprising:

a capacitor disposed inside said case, means for connecting said capacitor in parallel with the contacts of the circuit breaker and in series with a switch which opens during circuit breaker opening of said main and arcing contacts, said capacitor being constituted by a stack of capacitor components disposed in an insulating tube fixedly mounted in said chamber, said means for connecting said capacitor in parallel with said contacts of said circuit breaker comprising means for connecting a first end of the stack electrically to a first current terminal of the circuit breaker, and at least one arm connecting a second end of the stack to an electrode fixed to a piece of said moving equipment and selectively operably engaging said at least one arm, said at least one arm and said electrode constituting said switch, and means electrically connecting said piece to a second current terminal of said circuit breaker, and said electrode comprising a tube coaxial with said case and internally of said case.

2. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arching contact fixedly mounted within said at least one chamber, at least one moving main contact and at least one moving arcing contact mounted within said at least one chamber for movement towards and away from said fixed main contact and said fixed arcing contact respectively, means for moving said moving main and arcing contacts towards and away from said fixed main contact and said fixed arcing contact respectively, said chamber further comprising a cylinder, a blast piston within said cylinder, and a blast nozzle, the improvement comprising:

a capacitor, a varistor and a resistor inside said case, said varistor being made of one material of the group consisting of zinc oxide and silicon carbide and being connected in series with said resistor, means for electrically connecting said capacitor in parallel with said varistor and said resistor, and means forming a common point electrically connected to said capacitor, and said varistor and resistor, and being connected to a first current terminal of said high tension circuit breaker and operatively associated with an insertion mechanism for inserting said capacitor and said varistor and resistor in parallel with the capacitor, momentarily in parallel with said arcing contacts of said high tension circuit breaker during at least one of disengagement and engagement of the main and arcing contacts of the circuit breaker, and wherein said varistor and said resistor are constituted by a stack of components disposed in an insulating tube within said chamber, and wherein said capacitor is constituted by a truncated cone coaxial with said insulating tube and at least in part surrounding said insulating tube internally of said chamber.

3. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arcing contact fixedly mounted within said at least one chamber, at least one moving main contact and at least one moving arcing contact mounted within said at least one chamber for movement towards and away from said fixed main contact and said fixed arcing contact respectively, means for moving said moving main and arcing contacts respectively towards and away from said fixed main contact and said fixed arcing contact, said chamber further comprising a cylinder, a blast piston within said cylinder, and a blast nozzle, the improvement comprising:

a capacitor, a varistor and a resistor disposed in said case, said varistor being made of one material of the group consisting of zinc oxide and silicon carbide and connected in series with said resistor, means for electrically connecting said capacitor in parallel with said varistor and said resistor, and means forming a common point electrically connected to said capacitor and said varistor and resistor and being connected to a first current terminal of said high tension circuit breaker and operatively associated with an insertion mechanism for inserting said capacitor and said varistor and resistor in parallel with the capacitor momentarily in parallel with said arcing contacts of said high tension circuit breaker during at least one of disengagement and engagement of the main and arcing contacts of the circuit breaker, wherein the varistor is constituted by a stack of components disposed inside an insulating tube internally of said chamber, said wherein said capacitor is constituted by a stack of cylindrical components electrically connected in parallel internally of said chamber and extending parallel to the axis of the case.

4. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arcing contact fixedly mounted within said at least one chamber, at least one moving main contact and at least one moving arcing contact mounted within said at least one chamber for movement towards and away from said fixed main contact and said fixed arcing contact respectively, means for moving said moving main and arcing contacts respectively towards and away from said fixed main contact and said fixed arcing contact, said chamber further comprising a cylinder, a blast piston within said cylinder, and a blast nozzle, the improvement comprising:

a capacitor and a varistor made of one material of the group consisting of zinc oxides and silicon carbide, connected in series with a resistor being disposed inside said case, means for electrically connecting said capacitor in parallel with said varistor and said resistor, and means forming a common point electrically connected to said capacitor and said varistor and resistor and being connected to a first current terminal of said high tension circuit breaker and operatively associated with an insertion mechanism for inserting said capacitor and said varistor and resistor in parallel with the capacitor, momentarily in parallel with said arcing contacts of said high tension circuit breaker during at least one of disengagement and engagement of the main and arcing contacts of the circuit breaker, and wherein said insertion mechanism comprises at least one metal arm connected to a point electrically common to the varistor and the capacitor, and engagable with an electrode internally of the case and electrically connected with a second current terminal of the high tension circuit breaker.

5. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arcing contact fixedly mounted within said at least one chamber, moving equipment comprising at least one moving main contact and at least one moving arcing contact mounted within said at least one chamber for movement towards and away from said fixed main contact and said fixed arcing contact respectively, means for moving said moving main and arcing contacts respectively towards and away from said fixed main contact and said fixed arcing contact, said chamber further comprising a cylinder, a blast piston within said cylinder, and a blast nozzle, the improvement comprising:

a capacitor and a varistor made of one material of the group consisting of zinc oxide and silicon carbide, connected in series with a resistor being disposed inside said case, means for electrically connecting said capacitor in parallel with said varistor and said resistor, and means forming a common point electrically connected to said capacitor and said varistor and resistor and being connected to a first current terminal of said high tension circuit breaker and operatively associated with an insertion mechanism for inserting said capacitor and said varistor and resistor in parallel with the capacitor, momentarily in parallel with said arcing contacts of said high tension circuit breaker during at least one of disengagement and engagement of the main and arcing contacts of the circuit breaker, wherein said insertion mechanism comprises at least one metal arm electrically connected to a point electrically common to said varistor and said capacitor and operatively engaging an electrode internally of said case and electrically connected with a second current terminal, and wherein said second electrode is a metal tube fixed to a piece of said moving equipment and coaxially positioned about said cylinder and said blast piston internally of said cylinder.

6. In a multiple phase high tension circuit breaker comprising: at least one current interrupting chamber for each phase within a gastight cylindrical insulating case filled with gas having good dielectric properties such as sulfur hexafluoride $SF_6$, a fixed main contact and a fixed arcing contact fixedly mounted within said at least one chamber, moving equipment comprising at least one moving main contact and at least one moving arcing contact mounted within said at least one chamber for movement towards and away from said fixed main contact and said fixed arcing contact respectively, means for moving said moving main and arcing contacts respectively towards and away from said fixed main contact and said fixed arcing contact, said chamber further comprising a cylinder, a blast piston within said cylinder, and a blast nozzle, the improvement comprising:

a capacitor and a varistor made of one material of the group consisting of zinc oxides and silicon carbide, connected in series with a resistor being disposed inside said case, means for electrically connecting said capacitor in parallel with said varistor and said resistor, and means forming a common point electrically connected to said capacitor and said varistor and resistor and being connected to a first current terminal of said high tension circuit breaker and operatively associated with an insertion mechanism for inserting said capacitor and said varistor and resistor in parallel with the capacitor, momentarily in parallel with said arcing contacts of said high tension circuit breaker during at least one of disengagement and engagement of the main and arcing contacts of the circuit breaker, and wherein said insertion mechanism comprises at least one metal arm connected to a point electrically common to the varistor and the capacitor, and engagable with an electrode internally of the case and electrically connected with a second current terminal of the high tension circuit breaker, said electrode comprises a metal piece including a head engagable in electrical contact with said at least one arm when the circuit breaker contacts are in engaged position, said metal piece further comprising an abutment slidably mounted in a metal tube mechanically and electrically connected to said cylinder having mounted internally, said blast piston and forming a part of said moving equipment and being electrically connected to said second current terminal, a metal braid electrically connecting said abutment to said metal tube, said head carrying a first magnet, said at least one arm carrying a second magnet, and said magnets moving to a common level and in juxtaposition when the circuit breaker is in circuit breaker contact engaged position, such that inertia and attraction force between said magnets when at the same level is sufficient to cause said metal piece to remain for an instant in contact with said electrode in spite of movement of said moving equipment during a circuit breaker contact disengagement operation of said circuit breaker.

7. The circuit breaker according to claim 6, wherein the abutment is sized slightly smaller than the diameter of said metal tube within which said abutment is slidably positioned, and said metal tube includes at least one hole within the periphery thereof limiting the extent of compression of said gas within the interior of the metal tube by movement of said abutment in the direction of movement of said moving equipment to circuit breaker contact closed position.

* * * * *